US006798329B2

(12) United States Patent
Kobayashi et al.

(10) Patent No.: US 6,798,329 B2
(45) Date of Patent: Sep. 28, 2004

(54) INDUCTOR

(75) Inventors: Osamu Kobayashi, Iwata-gun (JP); Osamu Yamada, Iwata-gun (JP); Yukio Suzuki, Iwata-gun (JP); Kiyoshi Ito, Iwata-gun (JP); Mayuka Shirai, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 10/420,881

(22) Filed: Apr. 23, 2003

(65) Prior Publication Data

US 2004/0004526 A1 Jan. 8, 2004

(30) Foreign Application Priority Data

Jul. 2, 2002 (JP) ..... 2002-193192

(51) Int. Cl.[7] ..... H01F 27/24
(52) U.S. Cl. ..... 336/233; 336/178
(58) Field of Search ..... 336/178, 233

(56) References Cited

U.S. PATENT DOCUMENTS

2001/0026205 A1 10/2001 Paris et al.

FOREIGN PATENT DOCUMENTS

| | | |
|---|---|---|
| EP | 0 980 856 A1 | 2/2000 |
| EP | 0 980 857 A1 | 2/2000 |
| EP | 1 101 736 A1 | 5/2001 |

OTHER PUBLICATIONS

M.A. Ahmed et al. "Effect of $Ti^{4+}$ ions on the magnetic and dielectric properties of Mg–ferrite", Journal of Magnetism and Magnetic Materials vol. 232, 2001, pp. 194–204.

*Primary Examiner*—Ramon M. Barrera
(74) *Attorney, Agent, or Firm*—Oliff & Berridge PLC

(57) ABSTRACT

In an inductor comprising an open magnetic path formed by a soft magnetic material and a winding provided around the open magnetic path, the soft magnetic material has its relative complex dielectric constant varying according to a frequency. In the soft magnetic material, the imaginary part of the relative complex dielectric constant is greater than the real part thereof in a high-frequency band equal higher than the frequency of the electric signal flowing in the winding. Specifically, the soft magnetic material has a resistivity of 150 Ωm, has a real part of the relative complex dielectric constant, ranging from 1,000 to 20,000 at 1 kHz and 50 or less at 1 MHz, and the imaginary part is greater than the real part at 1 MHz.

4 Claims, 2 Drawing Sheets

| | μi | Bs | ρv | ε' | | tanδ2 (ε"/ε') |
|---|---|---|---|---|---|---|
| | (0.1MHz) | (1,194A/m) | (Ω m) | (1kHz) | (1MHz) | (1MHz) |
| S1 | 857 | 410 | 1,000 | 12,320 | 32 | 2.4 |
| S2 | 861 | 390 | 1,000 | 10,970 | 28 | 2.1 |
| S3 | 853 | 420 | 0.1 | 58,430 | 18,800 | 3.5 |
| S4 | 864 | 370 | 10,000 | 22 | 17 | 0.002 |
| S5 | 847 | 250 | 10,000 | 56 | 51 | 0.003 |

| | Basic component composition (mol %) | | | | | | | |
|---|---|---|---|---|---|---|---|---|
| | $Fe_2O_3$ | MnO | ZnO | $TiO_2$ | $SnO_2$ | NiO | MgO | CuO |
| S1 | 47.0 | 41.5 | 10.5 | 1.0 | — | — | — | — |
| S2 | 47.0 | 39.5 | 10.5 | — | 0.5 | — | — | 1.5 |
| S3 | 53.0 | 37.5 | 9.5 | — | — | — | — | — |
| S4 | 48.5 | — | 31.5 | — | — | 15.0 | — | 5.0 |
| S5 | 48.5 | 2.0 | 18.5 | — | — | — | 31.0 | — |

| | μi | Bs | ρv | ε' | | $\tan\delta_2$ (ε"/ε') |
|---|---|---|---|---|---|---|
| | (0.1MHz) | (1,194A/m) | (Ω m) | (1kHz) | (1MHz) | (1MHz) |
| S1 | 857 | 410 | 1,000 | 12,320 | 32 | 2.4 |
| S2 | 861 | 390 | 1,000 | 10,970 | 28 | 2.1 |
| S3 | 853 | 420 | 0.1 | 58,430 | 18,800 | 3.5 |
| S4 | 864 | 370 | 10,000 | 22 | 17 | 0.002 |
| S5 | 847 | 250 | 10,000 | 56 | 51 | 0.003 |

INDUCTOR

BACKGROUND OF THE INVENTION

1. Field of the Invention

The present invention relates to an inductor, and particularly to an inductor which works practically and effectively in a high-frequency band.

2. Description of the Related Art

It has been becoming more and more important to reduce the noise of electronic apparatus as the electronic apparatus are required to be downsized and achieve higher performance. In order to reduce the noise, various types of inductors have been used. For example, for heavy current applications and in a relatively low-frequency band, a ferrous dust magnetic core and an amorphous magnetic core both having a high saturation magnetic flux density have been used, and they are mainly shaped a toroidal. On the other hand, for use in a relatively high-frequency band, an Ni—Zn ferrite having a high resistivity ($10^2$ to $10^5$ Ωm) has been used.

In recent years, there has been a growing demand for high-frequency inductors since the electronics apparatus are increasingly required to have higher performances at higher frequencies. The aforementioned Ni—Zn ferrite is preferred also because a wire can be wound directly on the magnetic core owing to its high resistivity. However, since the Ni—Zn ferrite has a low saturation magnetic flux density, it is not often used in a closed magnetic path, but is often used as a drum-shaped or a rod-shaped magnetic core which is an open magnetic.

As described above, the Ni—Zn ferrite has been used in an inductor for a high-frequency application. However, the Ni—Zn ferrite requires a special purpose manufacturing process because the Ni—Zn ferrite contains Ni in its raw material thereby raising the problem with manufacturing cost and technology. On the other hand, an Mn—Zn ferrite which is inexpensive and shows superior characteristics generally has a low resistivity, ranging from 0.1 to 1 Ωm. As a result, an eddy current loss starts to increase even at a low frequency, and therefore, the Mn—Zn ferrite can be used only up to a few hundred kHz. In a frequency band exceeding a few hundred kHz, the Mn—Zn ferrite has magnetic permeability (initial permeability) remarkably decreased and totally loses its soft magnetic characteristic. The Mn—Zn ferrite, which has a low resistivity as mentioned above, requires an insulation covering or coating to prevent insulation failure which prohibits a wire from being wound directly on the core, resulting in increased cost, thus substantially limiting its applications.

In general, an equivalent circuit of an inductor is simply formed by a series equivalent circuit which is composed of a resistance component R and an inductive reactance L. More specifically, as shown in FIG. 5, it is formed by a series-parallel circuit which is composed of a series combination of the inductive reactance L and its resistance component R1 and another series combination of a capacitive reactance C and its resistance component R2. Here, the capacitive reactance C consists of a stray capacitance produced between the wires and another stray capacitance produced between the core and the winding. The resistance component R1 of the inductive reactance L consists of a resistance of a copper loss due to a wire resistance and another resistance due to a magnetic loss of the magnetic core. On the other hand, the resistance component R2 of the capacitive reactance C consists of a loss (the loss depends on a dielectric loss as described later) caused by an electric coupling between the core and the winding. The equivalent circuit thus formed causes an LC resonance in a frequency characteristic of the inductor, showing the hill-like impedance characteristic curve.

Q factor is a well-known indicator or sharpness of the LC resonance of the inductor. A large Q factor causes a sharp resonance and a smaller Q factor causes a less sharp resonance. The Q factor of the inductor is approximately determined by the environment of an electronic circuit. In recent years, since electric apparatuses have been required to be adapted for higher frequency and to be digitalized, inductors capable of reducing the high-frequency noise are becoming more and more important. In addition, parts provided with countermeasures against noise which efficiently absorb noise components without distorting the transmission signal wave are increasingly demanded.

When the resonance is caused with a sharp impedance of an inductor due to a large Q factor, the inductance changes sharply according to the resonance frequency, thereby causing noise and possibly distorting the transmission signal wave. Therefore, an inductor is demanded which does not produce the above mentioned resonance with a sharp impedance characteristic and which can be duly used in a high-frequency band.

As described above, the magnetic core made of a soft magnetic material such as an Mn—Zn ferrite is inexpensive and shows superior characteristics in a low frequency band, but since the Mn—Zn ferrite is very low in resistivity, its eddy current loss starts to increase even at a low frequency, and therefore the Mn—Zn ferrite can be used only up to a few hundred kHz. And the Mn—Zn ferrite requires an insulation covering or coating to prevent insulation failure caused by the low resistivity, which means a wire cannot be wound directly on the magnetic core, thus leading to increased cost. In order to solve the above conventional problems, the present inventors have disclosed in Japanese Patent Nos. 3108803 and 3108804 in which an Mn—Zn ferrite which has its resistivity remarkably increased by limiting $Fe_2O_3$ content to less than 50.0 mol %, and in addition, by allowing a suitable amount of $TiO_2$ or $SnO_2$ to be contained.

However, an inductor just using a ferrite with a high resistivity as a magnetic core cannot successfully reduce the noise without distorting the transmission signal wave. This is true of an Ni—Zn ferrite. When the Ni—Zn ferrite is used as a magnetic core, a resonance is caused in which the impedance characteristic, that is, a practical characteristic is sharp.

As described above, when the Ni—Zn ferrite is used as a magnetic core of an open magnetic path, the Q factor is large, thereby making the impedance of the inductor sharp in resonance. The Q factor is inversely proportional to a loss component of the inductor part. On the other hand, the loss component of the magnetic core involves, as described above, the magnetic loss and the dielectric loss (the ratio of an imaginary part to a real part of a relative complex dielectric constant), and the winding loss component involves the wire resistance. Out of these components, the magnetic loss and the dielectric loss depending on the characteristics of their materials are small in the Ni—Zn ferrite, and consequently the Q factor is large making the impedance of the inductor to easily resonate sharply. Therefore, an inductor is demanded which does not produce such a sharp resonance and, at the same time, which can be used in a high-frequency band.

SUMMARY OF THE INVENTION

The present invention has been made in view of the above described circumstances in the prior arts.

A first object of the present invention is to provide an inductor made of an inexpensive Mn—Zn ferrite which has its resistivity substantially increased thereby obtaining the same high-frequency characteristics as with the Ni—Zn ferrite and the same time enabling a wire be wound directly on the magnetic core of the inductor. A second object of the present invention is to provide an inductor which can reduce its noise without adversely affecting the transmission signal wave form.

In order to achieve the above objects, according to a first aspect of the present invention, in an inductor, which comprises an open magnetic path formed by a soft magnetic material and a winding provided around the open magnetic path a relative complex dielectric constant of the soft magnetic material varies according to a frequency, and an imaginary part of the relative complex dielectric constant is greater than a real part thereof in a high frequency band equal to and higher 1 MHz. Consequently, the inductor of the present invention achieves a high-frequency characteristic equivalent to that by the conventional Ni—Zn ferrite inductor, allows the winding to be provided directly on the core has an excellent impedance characteristic, and does not affect adversely the transmission signal wave form.

According to a second aspect of the present invention, in the inductor of the first aspect, the soft magnetic material has a resistivity of at least 150 Ωm and has a real part of the relative complex dielectric constant ranging between 1,000 and 20,000 including 1,000 and 20,000 at 1 kHz, and 50 or less at 1 MHz. Consequently, the inductor of the present invention can be duly used in a practical frequency band.

According to a third aspect of the present invention, in the inductor of the first aspect, the soft magnetic material has a basic component composition of an Mn—Zn ferrite comprising 44.0 to 50.0 mol % $Fe_2O_3$ (excluding 50.0 mol %), 4.0 to 26.5 mol % ZnO, 0.1 to 8.0 mol % at least one of $TiO_2$ and $SnO_2$, and the remainder consisting of MnO. Consequently, the inductor of the present invention can be duly used in a practical frequency band.

According to a fourth aspect of the present invention, in the inductor of the first aspect, the soft magnetic material has a basic component composition of an Mn—Zn ferrite comprising 44.0 to 50.0 mol % $Fe_2O_3$ (excluding 50.0 mol %), 4.0 to 26.5 mol % ZnO, 0.1 to 8.0 mol % at least one of $TiO_2$ and $SnO_2$, 0.1 to 16.0 mol % CuO, and the remainder consisting of MnO. Thus, the inductor of the present invention can be formed basically of the inexpensive Mn—Zn ferrite with a high resistivity and therefore can be low in cost and high in performance.

DETAILED DESCRIPTION OF THE PREFFERRED EMBODIMENTS

As described above, a magnetic core made of a soft magnetic material such as a ferrite has not only magnetic property but also a dielectric property, and has its relative complex dielectric constant varied according to a frequency. Therefore, its impedance |Z| is affected by the relative complex dielectric constant $\epsilon$. From now on, the magnetic core made of a soft magnetic material will be discussed, considering not only a complex permeability $\mu$ but also a relative complex dielectric constant $\epsilon$. Here, the complex permeability $\mu$ and magnetic loss (tan $\sigma_1$ and the relative complex dielectric constant $\epsilon$ and dielectric loss (tan $\sigma_2$) are defined as follows:

$$\mu=\mu'-j\,\mu'' \tag{1}$$

$$\tan\sigma_1=\mu''/\mu' \tag{2}$$

where $\mu'$ is a real part of the complex permeability $\mu$ and $\mu''$ is an imaginary part of the complex permeability $\mu$.

$$\epsilon=\epsilon'-j\,\epsilon'' \tag{3}$$

$$\tan\sigma_2=\epsilon''/\epsilon'\text{tm} \quad (4)$$

where $\epsilon'$ is a real part of the relative complex dielectric constant $\epsilon$ and $\epsilon''$ is an imaginary part of the relative complex dielectric constant $\epsilon$.

Figure 5:
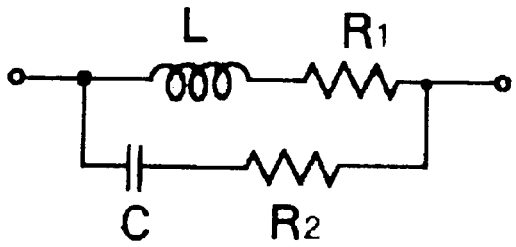
FIG. 5 is an equivalent circuit of an inductor.

In an equivalent circuit shown in FIG. 5, an inductive reactance L is proportional to $\mu'$, and a resistance component R1 is proportional to $\mu''$. On the other hand, an electric coupling between a core and a winding depends on a dielectric constant of the core. In this connection, the real part $\epsilon'$ of the relative complex dielectric constant $\epsilon$ is a capacitive reactance C between the core and the winding and a resistance component R2 of the capacitive reactance C can be considered as follows. The imaginary part $\epsilon''$ of the relative complex dielectric constant $\epsilon$ works as a resistance component. In other words, the imaginary part $\epsilon''$ can be regarded as a resistance component which depends on the dielectric loss, and can be referred to as R2 in the equivalent circuit.

Two or more different materials, whose real part $\mu'$and imaginary part $\mu''$ of the complex permeability $\mu$ are equivalent in characteristics respectively to each other, have their impedance characteristics (Q factors) differing from each other if they are different in dielectric characteristic from each other. In a soft magnetic material having a large dielectric loss (tan $\sigma_2$), the resistance component R2 shown in FIG. 5 increases making the Q factor of the circuit decrease, whereby the circuit does not resonate with a sharp impedance characteristic.

Since the conventional Mn—Zn ferrite has a large dielectric loss (tan $\sigma$) the circuit does not resonate with a sharp impedance characteristic. However, since the conventional Mn—Zn ferrite has a very low resistivity, as described above, an eddy current loss starts to increase even at a low-frequency, consequently, the conventional Mn—Zn ferrite can be used only up to a few hundreds kHz and therefore, cannot be used in a high frequency band. Also, the real part of the relative complex dielectric constant has a substantially constant value mostly greater than 20,000 from a low frequency (1 kHz) to a high frequency (1 MHz). As a result, an initial permeability thereof becomes a cause of resonance in a low-frequency band.

Furthermore, in the conventional Mn—Zn ferrite and the conventional Mg—Zn ferrite the real parts of the relative complex dielectric constant have substantially constant values, ranging around 20 or 50, respectively, from a low frequency (1 kHz) to a high frequency (1 MHz). Consequently, both ferrites can be used in a high-frequency band. However, since the both ferrites have a small dielectric loss (tan $\sigma_2$), they cause a resonance with a sharp impedance characteristics.

The present inventors have discovered a soft magnetic material which has the real part of its relative complex dielectric constant sharply decreasing from 1 kHz (low frequency band) to 1 MHz (high frequency), has a dielectric loss (tan $\sigma_2$) of 1 or larger in a high-frequency band that an inductor which comprises an open magnetic path formed of the above soft magnetic material and a winding wound around the open magnetic path, does not have a resonance with a sharp impedance characteristic, and that the soft magnetic material has a small real part of the relative complex dielectric constant at 1 MHz, and therefore achieves superior characteristics in the high-frequency band.

The present invention utilizes the action that the soft magnetic material has its dielectric loss (tan $\sigma_2$) varying according to the frequency and has an imaginary part of the relative complex dielectric constant greater than a real part thereof in the high-frequency band. Specifically, the soft magnetic material proposed in the present invention has a capacitive reactance which depends on the real part of the relative complex dielectric constant, the relative complex dielectric constant of the soft magnetic material varies according to the frequency, and the real part decreases markedly in the high-frequency band, thus rendering the imaginary part greater than the real part thereof in the high-frequency band, which affects the resistance component R2 of the capacitive reactance.

Figures 1, 2, 3:
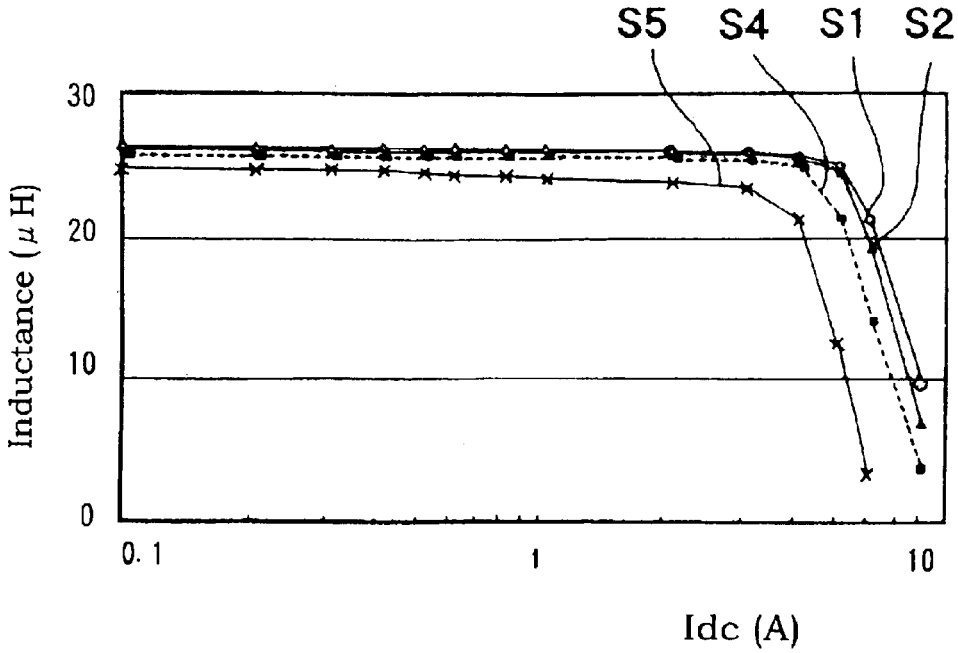
FIG. 1 is a table showing basic component compositions of magnetic cores made of soft magnetic materials according to embodiments of the present invention and magnetic cores made of soft magnetic materials for comparison purposes.
FIG. 2 is a table showing measurements of basic characteristics of toroidal cores comprising the basic component compositions shown in FIG. 1.
FIG. 3 is a graph showing DC bias characteristics of Samples 1, 2, 4 and 5.

Examples 1 and 2 will hereinafter be explained. FIG. 1 is a table showing basic component compositions (unit mol %) of five magnetic cores, Sample 1 (S1), Sample 2 (S2), Sample 3 (S3), Sample 4 (S4) and Sample 5 (S5). Sample 1 and Sample 2 are made of soft magnetic materials which are described in detail in Examples 1 and 2 of the present invention, respectively, and Sample 3, Sample 4 and Sample 5 are made of conventional soft magnetic materials for comparison purpose. In the examples described above, a signal to be used has a frequency of 10 MHz or lower, and a resistivity $\rho$ is determined by a voltage applied to a cable for a signal line or a power supply line within a range used for usual applications without problem. The soft magnetic material used in the present invention has a remarkably large resistivity about $10^3$ times as large as the conventional Mn—Zn ferrite, specifically, $\rho=0.15\ \Omega m\times10^3$, that is, 150 $\Omega$m. On the above condition, the basic component composition of the soft magnetic material has been determined such that the real part of the relative complex dielectric constant of the above soft magnetic material is between 1,000 and 20,000 at 1 kHz, and is 50 or less at 1 MHz, and at the same time the imaginary part of the relative complex dielectric constant is, greater than the real part thereof at 1 MHz.

EXAMPLE 1

As shown by S1 in the table of FIG. 1, Sample 1 has a basic component composition of 47.0 mol % $Fe_2O_3$, 10.5 mol % ZnO, 1.0 mol % $TiO_2$, and 41.5 mol % MnO, with respective mol % determined to fall within the range of 44.0 to 50.0 mol % $Fe_2O_3$ (excluding 50.0 mol %), 4.0 to 26.5 mol % ZnO, 0.1 to 8.0 mol % at least one of $TiO_2$ and $SnO_2$, and the remainder consisting of MnO.

Raw material powders of $Fe_2O_3$, ZnO, $TiO_2$ and MnO as main components were weighed so as to conform to the previously defined compositions as shown in the table of FIG. 1, and mixed with a ball mill, and the resultant mixed powder was calcined in the air at 900° C. for 2 hours. Then, the mixed powder was pulverized with the ball mill until an average grain size thereof was reduced to approximately 1.4 $\mu$m. The mixed powder with addition of polyvinyl alcohol was granulated and pressed at a pressure of 80 MPa into toroidal cores, rod cores and disk pellet cores (for measuring a dielectric constant). Each of the toroidal cores had an outer diameter of 15 mm, an inner diameter of 8 mm and a height of 3 mm in the form of molding after sintering. Each of the rod cores had an outer diameter of 10 mm and a height of 24 mm in the form of molding after sintering. Each of the pellet cores had an outer diameter of 10 mm and a height of 3 mm in the form of molding after sintering. Then, they were sintered at 1,150° C. for 3 hours in an atmosphere adjusted by allowing nitrogen to flow thereinto so as to have a partial pressure of oxygen controlled.

EXAMPLE 2

As shown by S2 in the table of FIG. 1, Sample 2 has a basic component composition of 47.0 mol % $Fe_2O_3$, 10.5 mol % ZnO, 0.5 mol % $SnO_2$, 39.5 mol % MnO, and 1.5 mol % CuO, with respective mol % determined to fall within the range of 44.0 to 50.0 mol % $Fe_2O_3$ (excluding 50.0 mol %), 4.0 to 26.5 mol % ZnO, 0.1 to 8.0 mol % at least one of $TiO_2$ and $SnO_2$, 0.1 to 16.0 mol % CuO and the remainder consisting of MnO.

Raw material powders of $Fe_2O_3$, ZnO, $SnO_2$, $TiO_2$, MnO and CuO as main components were weighed so as to conform to the previously defined compositions as shown in the table of FIG. 1 then mixed with a ball mill, and the resultant mixed powder was calcined in the air at 900° C. for 2 hours. Then, the mixed powder was pulverized with the ball mill until an average grain size thereof was reduced to approximately 1.4 $\mu$m.

The mixed powder with addition of polyvinyl alcohol was granulated and pressed at a pressure of 80 MPa into toroidal cores, rod cores and disk pellet cores (for measuring a dielectric constant). Each of the toroidal cores had an outer diameter of 15 mm, an inner diameter of 8 mm and a height of 3 mm in the form of molding after sintering. Each of the rod cores had an outer diameter of 10 mm and a height of 24 mm in the form of molding after sintering. Each of the pellet cores had an outer diameter of 10 mm and a height of 3 mm in the form of molding after sintering. Then, they were sintered at 1,150° C. for 3 hours in an atmosphere adjusted by allowing nitrogen to flow thereinto so as to have a partial pressure of oxygen controlled.

In this connection, raw material powders of $Fe_2O_3$, ZnO, MnO, NiO, MgO and CuO as main components of respective soft magnetic materials used for comparison were weighed so as to conform to the previously defined compositions as shown by S3, S4 and S5 in FIG. 1, then mixed with a ball mill, and the resultant mixed powder was calcined in the air at 900° C. for 2 hours. Then, the mixed powder was pulverized with the ball mill until an average grain size thereof was reduced to approximately 1.4 $\mu$m.

The mixed powder with addition of polyvinyl alcohol was granulated and pressed at a pressure of 80 MPa into toroidal cores, rod cores and disk pellet cores (for measuring a dielectric constant). Each of the toroidal cores had an outer diameter of 15 mm, an inner diameter of 8 mm and a height of 3 mm in the form of molding after sintering. Each of the rod cores had an outer diameter of 10 mm and a height of 24 mm in the form of molding after sintering. Each of the pellet cores had an outer diameter of 10 mm and a height of 3 mm in the form of molding after sintering. Then, Sample 3 was sintered at 1,150° C. for 3 hours in an atmosphere adjusted by allowing nitrogen to flow thereinto so as to have a partial pressure of oxygen controlled. Samples 4 and 5 were sintered in the air at 1,150° C. for 3 hours.

Referring to FIG. 1 shown therein are measurements of initial permeabilities $\mu i$ at 0.1 MHz, saturation flux densities Bs at 1,194 A/m, resistivities ρv real parts $\epsilon'$ of relative complex at 1 kHz and 1 MHz, dielectric constants, and ratios (tan $\sigma_2=\epsilon''/\epsilon'$) of respective imaginary parts $\epsilon''$ to respective real parts $\epsilon'$ of relative complex dielectric constants at 1 MHz. Dielectric characteristics were measured by applying an AC voltage to electrodes formed on both faces of the disk pellet cores with Au vacuum evaporation.

As apparent from the table of FIG. 2, Sample 1, Sample 2, and Sample 4 of an Ni—Zn ferrite achieve practical values in the initial permeabilities $\mu i$, the saturation flux densities Bs and the resistivities ρv. However, since Sample 4 has a very small dielectric loss (tan $\sigma_2=\epsilon''/\epsilon'$) at 1 MHz compared with Samples 1 and 2, Sample 4, when used as an inductor, makes the Q factor very large, thereby easily causing resonance with a sharp impedance characteristic.

On the other hand, Sample 3 of a general Mn—Zn ferrite achieves practical values in the initial permeability $\mu i$ and the saturation flux density Bs, but has a very low resistivity, thus making it difficult to use in a high-frequency band. Further, since Sample 3 has a very low resistivity, it is necessary to provide a thin insulating film on a surface thereof or to use a cable having an insulating film. Therefore, Sample 3 is limited in its applications.

Sample 5 of an Mg—Zn ferrite has a low saturation flux density Bs, and therefore has no advantage over the other samples. In particular, since it is required no magnetic saturation occurs when a direct current is biased against an inductor, Sample 5, which has a low saturation flux density, must have its core size increased Referring to FIG. 3 changes in inductances of a primary winding at 1 kHz are each measured by applying a direct current Idc to a duplex winding comprising a primary winding of 20 turns provided directly on the rod core and a secondary winding of 130 turns provided over the primary winding. Sample 5 having the lowest saturation flux density among the five samples as shown in the table of FIG. 2 begins to decrease in inductance at the smallest direct current Idc as shown in FIG. 3, which indicates that the lower the saturation flux density is, the earlier the effect by the direct current Idc begins to appear. Therefore, Samples 1, 2, 4 and 5 have a better inductance characteristic in this order.

Figure 4:
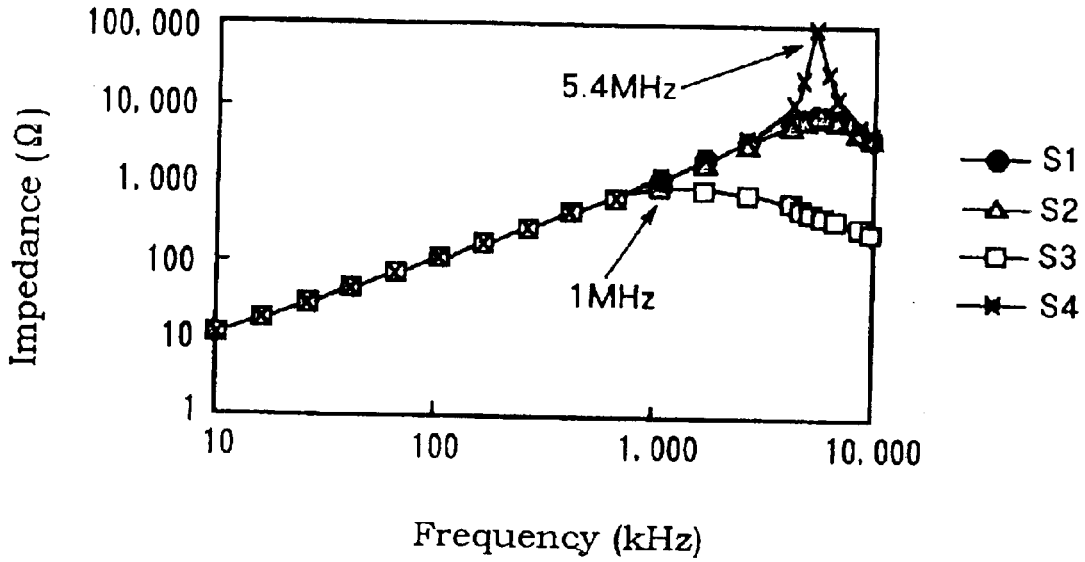
FIG. 4 is a graph showing changes in impedances of inductors made of Samples 1, 2, 3 and 4.

Referring to FIG. 4 the axis of ordinates represents impedance |Z| and the axis of abscissas represents frequency. The changes in the inductance were measured on the rod cores each having a winding of 150 turns provided directly thereon. As apparent from the graph of FIG. 4, Samples 1 to 4 all show the same impedance characteristic up to 1 MHz, but Sample 4 only shows a sharp resonance with a remarkable change in the impedance in the neighborhood of 6 MHz. On the other hand, Samples 1 and 2 do not show a resonance involving a sharp change in the impedance. This is because, as shown in the table of FIG. 2 the tan $\sigma_2=\epsilon''/\epsilon'$of each of the dielectric losses of Samples 1 and 2 at 1 MHz is greatly different from the tan $\sigma_2=\epsilon''/\epsilon'$of each of the dielectric losses of Samples 1 and 2 at 1 MHz and the dielectric loss tan $\sigma_2$ at 1 MHz exceeds 1.

Sample 3, although not showing a resonance with a sharp impedance characteristic decreases significantly in impedance in a high-frequency band.

Samples 1, 2 and 4 are equal in reduction of noise, but Samples 1 and 2 of the present invention are superior to Sample 4 in reduced chances of affecting the signal wave form of transmission signals, especially digital signals.

From the above discussion, it is clear that Samples 1 and 2 of the present invention are superior to Sample 3 of an Mn—Zn ferrite, Sample 4 of an Ni—Zn ferrite, Sample 5 of an Mg—Zn ferrite in impedance characteristics and reduction of noise.

What is claimed is:

1. An inductor comprising an open magnetic path formed by a soft magnetic material and a winding provided around the open magnetic path, wherein a relative complex dielectric constant of said soft magnetic material varies according to a frequency, and an imaginary part of said relative complex dielectric constant is greater than a real part thereof in a high-frequency band equal to or higher than 1 MHz.

2. An inductor as claimed in claim 1, wherein said soft magnetic material has a resistivity of at least 150 Ωm, and has a real part of said relative complex dielectric constant ranging between 1,000 and 20,000 including 1,000 and 20,000 at 1 kHz, and 50 or less at 1 MHz.

3. An inductor as claimed in claim 1, wherein said soft magnetic material has a basic component composition of an Mn—Zn ferrite comprising 44.0 to 50.0 mol % $Fe_2O_3$ (excluding 50.0 mol %), 4.0 to 26.5 mol % ZnO, 0.1 to 8.0 mol % at least one of $TiO_2$ and $SnO_2$, and the remainder consisting of MnO.

4. An inductor as claimed in claim 1, wherein said soft magnetic material has a basic component composition of an Mn—Zn ferrite comprising 44.0 to 50.0 mol % $Fe_2O_3$ (excluding 50.0 mol %), 4.0 to 26.5 mol % ZnO, 0.1 to 8.0 mol % at least one of $TiO_2$ and $SnO_2$, 0.1 to 16.0 mol % CuO, and the remainder consisting of MnO.

* * * * *